United States Patent [19]

Kleefeldt

[11] Patent Number: 4,896,908

[45] Date of Patent: Jan. 30, 1990

[54] ELASTOMER-CLAD MOTOR-VEHICLE DOOR LATCH

[75] Inventor: Frank Kleefeldt, Heiligenhaus, Fed. Rep. of Germany

[73] Assignee: Kiekert GmbH & Co. Kommanditgesellschaft, Heiligenhaus, Fed. Rep. of Germany

[21] Appl. No.: 278,704

[22] Filed: Dec. 1, 1988

[30] Foreign Application Priority Data

Dec. 2, 1987 [DE] Fed. Rep. of Germany ..... 8715925

[51] Int. Cl.[4] ..... E05C 3/26

[52] U.S. Cl. ..... 292/216; 292/DIG. 38; 292/DIG. 56; 292/340

[58] Field of Search ..... 292/216, 280, DIG. 38, 292/341.12, 340, DIG. 56

[56] References Cited

U.S. PATENT DOCUMENTS

| | | | |
|---|---|---|---|
| 3,572,797 | 3/1971 | Shay | 292/340 X |
| 3,809,416 | 5/1974 | Kayooka | 292/216 |
| 4,466,645 | 8/1984 | Kobayashi | 292/216 |
| 4,647,092 | 3/1987 | Nakamura | 292/216 |
| 4,756,564 | 7/1988 | Ikeda | 292/216 |

*Primary Examiner*—Richard E. Moore

*Attorney, Agent, or Firm*—Herbert Dubno

[57] ABSTRACT

A motor-vehicle latch assembly comprises a locking bolt secured to a doorpost, a mounting plate secured to a door and provided with a pivot and formed therearound with a bearing surface, a locking fork formed with a pivot hole fitted over the pivot, having a side directly confronting the bearing surface, and engageable with the bolt on closing of the door, and an elastomeric cladding covering the fork including the interior of the hole in contact with the bolt and the side of the bolt in contact with the bearing surface. The cladding engages the bearing surface and eliminates play and metal-to-metal contact at this region.

6 Claims, 2 Drawing Sheets

ELASTOMER-CLAD MOTOR-VEHICLE DOOR LATCHcl FIELD OF THE INVENTION

The present invention relates to a door latch. More particularly this invention concerns such a latch used in a motor vehicle.

BACKGROUND OF THE INVENTION

A standard motor-vehicle door latch comprises a bolt attached to and extending perpendicularly from the doorpost and a latch on the door edge. The latch has a pivotal fork that engages around the bolt to secure the door tightly in place.

The bolt is typically part of a bolt assembly comprised of a metallic U-shaped yoke having an inner flange bolted to the doorpost and an outer flange spaced therefrom, forming a fork-receiving space therewith, and having an outer surface turned away from the inner flange. The bolt is also metallic and is permanently fixed to the two flanges so as to extend generally perpendicular therebetween.

When the door is closed the outer surface of the outer flange normally contacts the door, and of course the metallic latch fork engages over the metallic bolt. This metal-to-metal contact is noisy, and also leads to abrasion and some damage to the metal, leaving sharp edges.

In my copending application OH 203,245 filed Jun. 6, 1988, now U.S. patent Ser. No. 4,834,435 issued May 30, 1989, I describe an improved system wherein a nonmetallic resilient sleeve surrounds the bolt between the flanges of the yoke and a nonmetallic cover overlies at least the outer surface of the outer flange. Thus with the system of this earlier invention the bolt is cushioned so that it will cooperate with the fork quietly, and the surfaces of the yoke that engage the door edge are similarly cushioned. Even when a second sleeve of a material substantially more resistant to wear than the first sleeve surrounds the first-mentioned sleeve the noise that this latch makes is substantially reduced.

Such a construction still is likely to squeak and rattle slightly. Even though the contact between the fork and the bolt is cushioned somewhat, there remains substantial room for the creation of play and metal-to-metal contact.

OBJECTS OF THE INVENTION

It is therefore an object of the present invention to provide an improved cushioned door-latch assembly.

Another object is the provision of such an improved cushioned door-latch assembly which overcomes the above-given disadvantages, that is which does not squeak or rattle significantly.

SUMMARY OF THE INVENTION

A motor-vehicle latch assembly according to this invention comprises a locking bolt secured to a doorpost, a mounting plate secured to a door and provided with a pivot and formed therearound with a bearing surface, a locking fork formed with a pivot hole fitted over the pivot, having a side directly confronting the bearing surface, and engageable with the bolt on closing of the door, and an elastomeric cladding covering the fork including the interior of the hole in contact with the bolt and the side of the bolt in contact with the bearing surface. The cladding engages the bearing surface and eliminates play and metal-to-metal contact at this region.

According to another feature of this invention the cladding is unitarily formed as a single piece and incorporates a lubricant. It is possible to saturate a rubber- or synthetic-resin based elastomer with a lubricant for long-term lubrication effect. The cladding according to this invention is at least 1 mm thick.

In accordance with a further feature of this invention the bolt is also provided with an elastomeric cladding. Furthermore, the cladding is formed with formations engageable with other elements.

DESCRIPTION OF THE DRAWING

The above and other objects, features, and advantages will become more readily apparent from the following, reference being made to the drawing in which.

SPECIFIC DESCRIPTION

Figure 1:
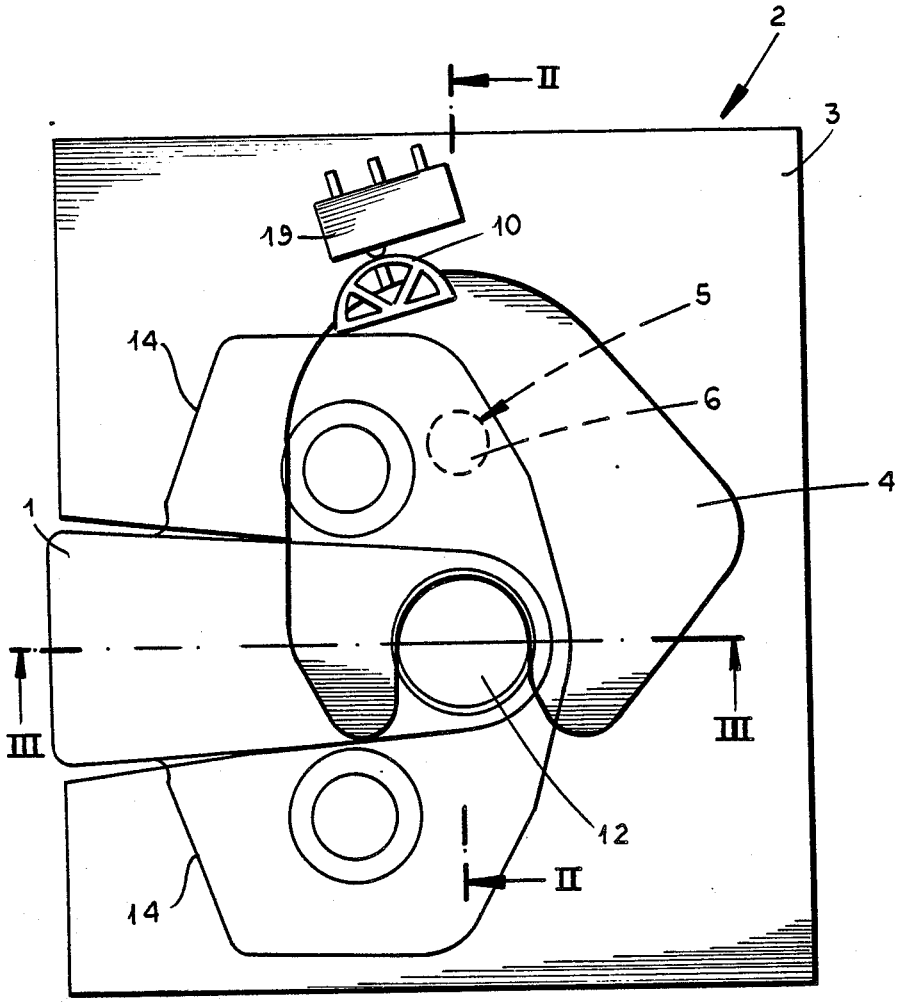
FIG. 1 is a side view of the latch assembly according to this invention.
Figure 2:
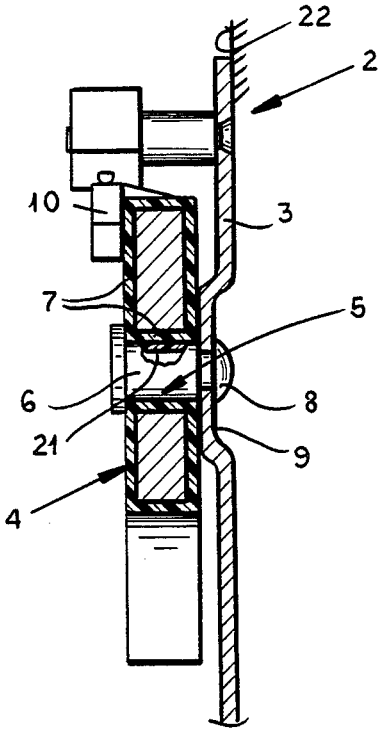
FIGS. 2 and 3 are sections taken along respective lines II—II and III—III of FIG. 1.
Figure 3:
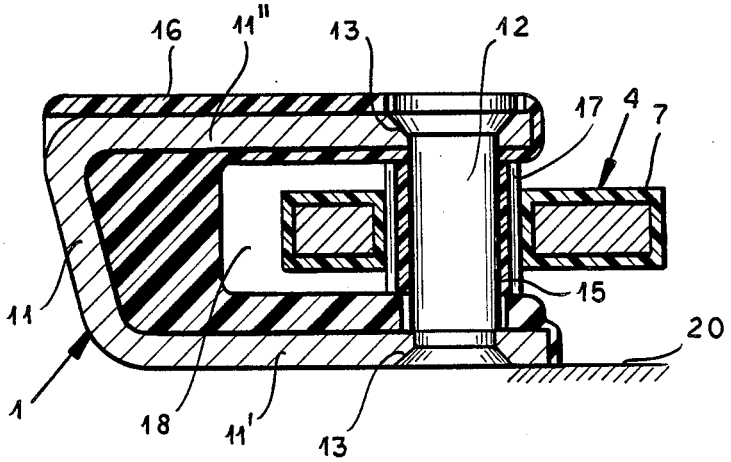

As seen in FIG. 1 a motor-vehicle-door latch comprises a wedge-shaped door bolt 1 normally mounted on the edge of a doorpost shown schematically at 20 in FIG. 3 and normally engageable as described in the above-identified patent application by a latch 2 comprising a support plate 3 fixed to the edge of the vehicle door shown schematically at 22 in FIG. 2. A latch fork 4 is formed with a pivot hole 5 fitted over a pivot bolt 6 having a head 8 fastened rivet-fashion to a raised boss 9 formed in the plate 3. The fork 4 is completely surrounded, including inside the pivot hole 5 with a layer or cladding of a slightly elastomeric synthetic resin. In addition the fork 4 is provided with such a cladding 21 as seen in FIG. 2. The cladding 2 of the fork 4 rides on the bearing surface 9' formed by the raised portion 9 of the mounting plate 3. This cladding 7 is at least about 1 mm thick and is formed unitarily with a formation in the nature of an actuating element 10 that coacts with a switch 19 serving to sense whether the door in question is locked completely.

As best seen in FIG. 3 the bolt 11 is basically formed by a U-section sheet-metal yoke 11 having a pair of flanges 11' and 11'' bridged by a standard latch bolt 12 which is here mounted rivet-fashion in these flanges 11' and 11'' and extends perpendicular to them. The flange 11' extends in its own plane as mounting ears 14 that are bolted directly to the vertical surface of the doorpost indicated schematically at 20.

The steel bolt 12, which is effectively integral with the steel yoke 11, is provided with an elastomerically resilient cover sleeve 15. In addition at this wear-prone region this sleeve 15 is in turn covered by a somewhat harder wear sleeve 17, for instance of a metal or a synthetic resin such as polyamide or polytetrafluorethylene.

In addition the yoke 11 is fitted with a synethetic-resin cover 16 which fits complementarily over its exposed flange 11'' and which fills its interior except for a pocket 18 left to accommodate the fork 4. This cover/-filler 16 can be molded right to the yoke 1, but normally is a separate element that is fitted to it.

I claim:

1. A motor-vehicle latch assembly comprising:

a locking bolt secured to a doorpost;

a mounting plate secured to a door and provided with a pivot and formed therearound with a bearing surface;

a locking fork formed with a pivot hole fitted over the pivot, having a side directly confronting the bearing surface, and engageable with the bolt on closing of the door; and an elastomeric cladding covering the fork including the interior of the hole in contact with the bolt and the side of the bolt in contact with the bearing surface, the cladding engaging the bearing surface.

2. The assembly defined in claim 1 wherein the cladding is unitarily formed as a single piece.

3. The assembly defined in claim 1 wherein the cladding incorporates a lubricant.

4. The assembly defined in claim 1 wherein the cladding is at least 1 mm thick.

5. The assembly defined in claim 1 wherein the bolt is also provided with an elastomeric cladding.

6. The assembly defined in claim 1 wherein the cladding is formed with a formation engageable with a switch.

* * * * *